US005461841A

United States Patent [19]

Spada et al.

[11] Patent Number: 5,461,841

[45] Date of Patent: Oct. 31, 1995

[54] DEVICE FOR FEEDING WRAPPER SHEETS, ESPECIALLY FOR USE IN CIGARETTE PACKING MACHINES

[75] Inventors: Valter Spada, Marzabotto; Giuseppe Tosi, Modena, both of Italy

[73] Assignee: Sasib S.p.A., Bologna, Italy

[21] Appl. No.: 207,052

[22] Filed: Mar. 8, 1994

[30] Foreign Application Priority Data

Mar. 10, 1993 [IT] Italy ..... GE93A0017

[51] Int. Cl.[6] ..... B65B 11/32

[52] U.S. Cl. ..... 53/234; 53/228; 53/389.1

[58] Field of Search ..... 53/225, 228, 230, 53/232, 233, 234, 389.1, 389.3, 389.4, 466, 74

[56] References Cited

U.S. PATENT DOCUMENTS

| | | | |
|---|---|---|---|
| 3,982,375 | 9/1976 | Focke | 53/389.3 |
| 4,428,177 | 1/1984 | Focke et al. | 53/234 |
| 4,495,746 | 1/1985 | Focke et al. | 53/389.5 |
| 4,543,863 | 10/1985 | Rader | 53/74 |
| 4,885,895 | 12/1989 | Focke et al. | 53/234 |
| 4,918,901 | 4/1990 | Ganberini et al. | 53/389.1 |
| 5,179,815 | 1/1993 | Cahill et al. | 53/228 |

FOREIGN PATENT DOCUMENTS

| | | | |
|---|---|---|---|
| 3731063 | 3/1988 | Germany . | |
| 0574788 | 12/1993 | Italy | 53/234 |

*Primary Examiner*—John Sipos
*Assistant Examiner*—Ed Tolan
*Attorney, Agent, or Firm*—Larson and Taylor

[57] ABSTRACT

Device for feeding sheets of, for example, foil, especially for use in cigarette packing machines, with a drum (7) having cells (2') in which the sheets (8) are folded around individual groups (3) of cigarettes (S) as each group (3) of cigarettes (S) is transferred from a transfer drum (1) having cells (2) to the folding drum (7) at a transfer point (T) where the cigarette-carrying cells (2, 2') of the two drums (1, 7) coincide face to face and to where the sheet (8) is fed in a predetermined position with respect to the group (3) of cigarettes (S) and between the cells (2, 2') of the two drums (1, 7) by a pick-up/positioning device (14, 114) associated with the transfer drum (1). The sheet (8) pick-up/positioning device consists of a separate pick-up/positioning drum (14, 114) supported coaxially with the transfer drum (1) and rotated (21) independently of it.

16 Claims, 2 Drawing Sheets

Figure 1:
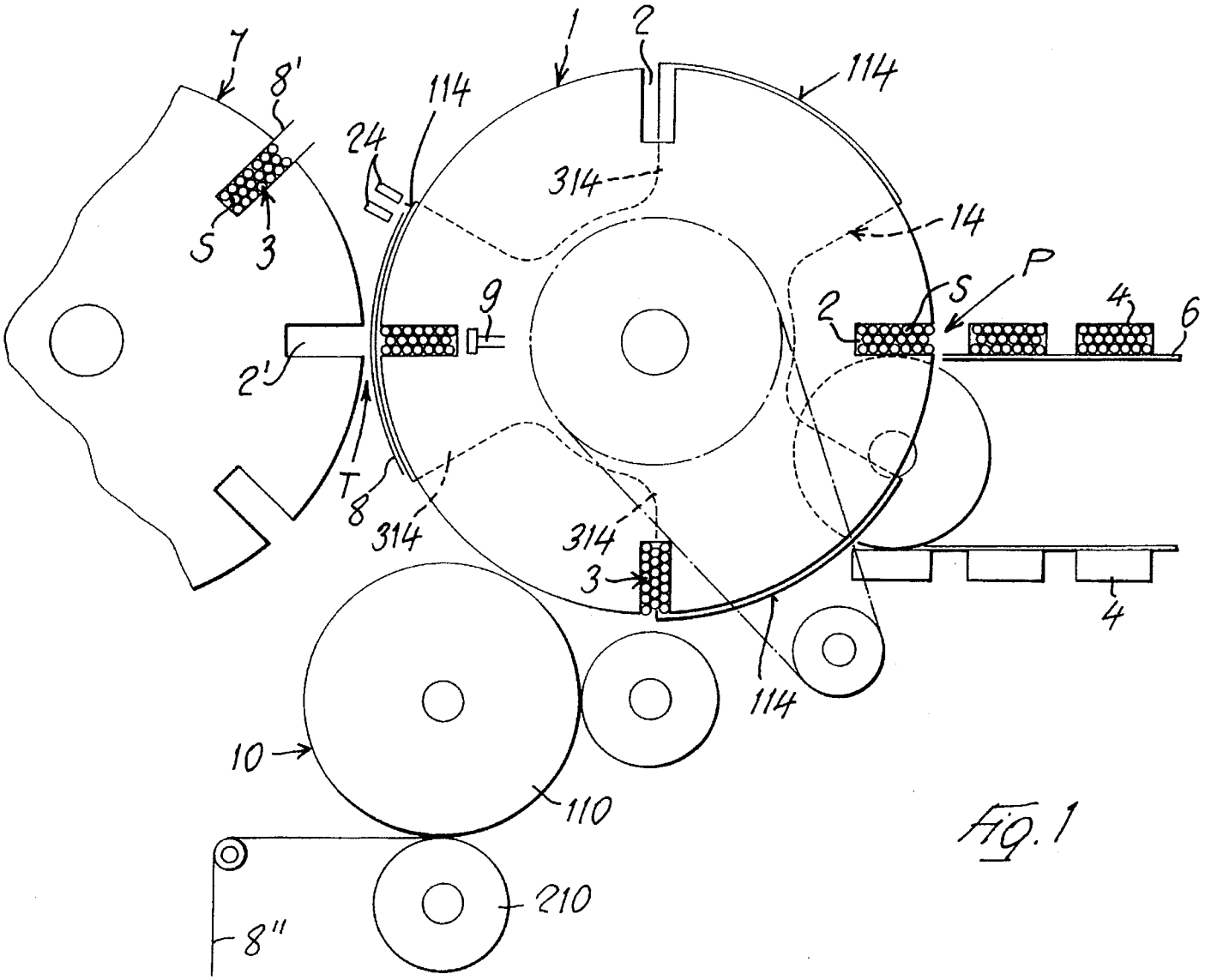

21
19
20
19

18
S
3
18
1
23
15
15
111
211
16
16
22
11
115
17
17
22
115
14
14
111
214
214
113
8
114
12
13

DEVICE FOR FEEDING WRAPPER SHEETS, ESPECIALLY FOR USE IN CIGARETTE PACKING MACHINES

The invention relates to a device for feeding wrapper sheets, especially for use in cigarette packing machines, which device comprises a drum in which the sheets of, for example, foil are folded around individual groups of cigarettes, said drum being provided around its periphery with a plurality of cigarette-carrying cells, and a drum which transfers groups of cigarettes from a feed line to the folding drum which is likewise provided with at least one cigarette-carrying cell, said cell being carried to a transfer point in a coinciding position of alignment in front of an empty cigarette-carrying cell in the folding drum, while the group of cigarettes is moved by displacement means out of the cell of the transfer drum into the cell of the folding drum, the transfer drum being associated with means which pick up and position one sheet at a time in a predetermined position next to the group of cigarettes being transferred, between the transfer drum cell and the folding drum cell at the transfer point, so that as the group of cigarettes is transferred into the folding drum cell, the sheet is pushed by the cigarettes themselves into said cell and folded around them in a U shape.

A device of this type is known from Patent Application DE-37 31 063: here, the foil sheet pick-up/positioning means are carried by the transfer drum itself, rotating with it alongside each cigarette-carrying cell of said drum. The sheets must therefore be picked up by the transfer drum itself, already in the correct predetermined position with respect to the corresponding cigarette-carrying cell, as no means are provided to enable its position relative to said cell to be adjusted. Moreover, the transfer drum has only two diametrically opposite cigarette-carrying cells which are moved alternately and simultaneously, in a half-rotation of the drum, firstly to a cigarette group feed point, where the feed line arrives, and secondly to the point of transfer to the folding drum. The known device is consequently unable to increase the speed of rotation of the transfer drum above a certain limit, owing to the fact that at very high speeds accurate picking-up and positioning of the sheet can no longer be guaranteed. This drawback necessarily means that sheets not correctly positioned must be discarded, or else a defectively made pack must be discarded later. This fact and the fact that only two cigarette-carrying cells are provided are the reason for the undesirable limiting of operating speeds and hence of hourly output.

The invention is accordingly based on the problem of how to construct a device for feeding wrapper sheets of, for example, foil, especially for use in cigarette packing machines, which by means of a simple and relatively inexpensive design enables these drawbacks to be overcome and so guarantees a higher hourly output and correct operation even at higher operating speeds.

The invention solves the above problem with a device for feeding sheets, especially for use in cigarette packing machines, in which the sheet pick-up/positioning means consist of a separate pick-up/positioning drum supported coaxially with the transfer drum and rotated independently of it.

This approach not only simplifies the construction of the transfer drum and of the pick-up/positioning means, but also makes it possible continuously to adjust the position of the sheet with respect to the corresponding cigarette-carrying cell of the transfer drum at the transfer point.

Another feature is that the pick-up/positioning drum consists of two discs arranged against the sides of the transfer drum, coaxially with each other and with said transfer drum and coupled to each other in rotation.

The transfer drum has two or more cigarette carrying cells, while the pick-up/positioning drum is provided with peripheral sheet-placing sectors in any number, preferably more or less than the number of cigarette-carrying cells of the transfer drum, the pick-up/positioning drum being operated relatively to said transfer drum in such a way that one sheet is brought simultaneously with each cigarette-carrying cell, and in the correct position, to the transfer point.

The transfer drum and the folding drum are turned stepwise and pause at at least the transfer point, while the pause at the transfer point of the pick-up/positioning drum, with the sheet in the correct predetermined position relative to the cigarette-carrying cell, is controlled by stationary sensors sensitive to the position and optionally to the presence of the sheet which turn on or off a motor driving the pick-up/positioning drum.

In this way the sheet can always be positioned in the correct relative position with respect to the associated group of cigarettes, and as a result the influence of synchronization errors, imprecisions in the rotary motion of the transfer drum and pick-up/positioning drum and errors in the position in which the sheet is picked up by the corresponding sheet-placing sector, are eliminated.

The sheet-placing sectors advantageously work by suction.

They consist of axially adjacent pairs of suction areas in the peripheral edges of the discs forming the pick-up/positioning drum.

Said sectors extend to a radial distance from the axis of rotation which is slightly greater than the external diameter of the transfer drum and are at least approximately equal in length to the sheet, or preferably slightly longer.

Their axial distance apart is less than the dimension, in the axial direction, of the sheets.

The sheet-placing sectors are preferably carried by basically radial arms rigidly connected together by a common hub.

The invention also encompasses other features which further improve the above wrapper sheet feeding device and are the subject matter of the subsidiary claims.

Figure 2:
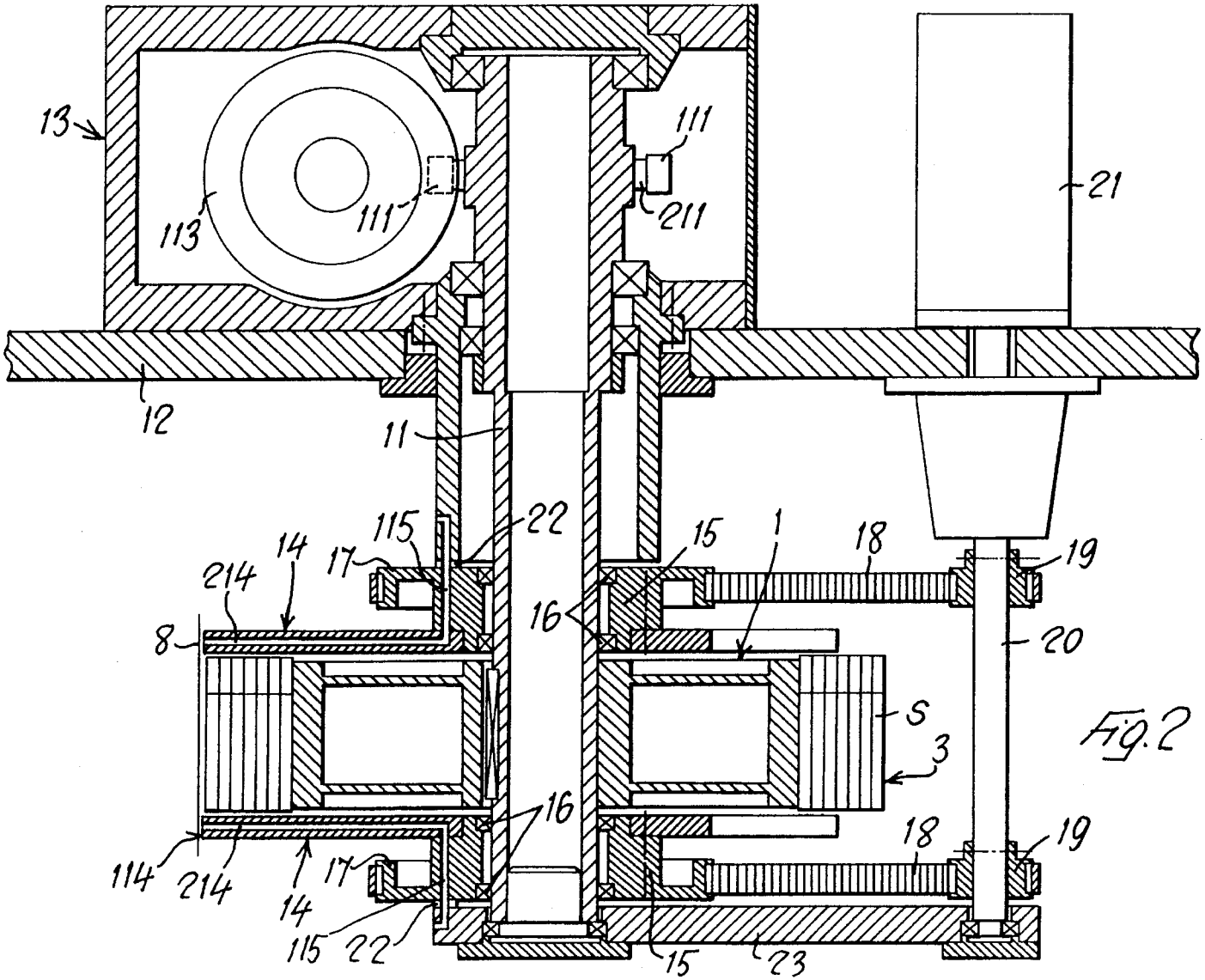

The distinctive features of the invention and its resulting advantages will appear in greater detail in a description of a preferred embodiment, which is illustrated as a non-limiting example in the accompanying drawings, in which:

FIG. 1 is a schematic front view of a feeder device according to the invention, and FIG. 2 is an axial section on a larger scale of the details of the transfer drum and associated pick-up/positioning drum shown in FIG. 1.

With reference to FIG. 1, a device for feeding sheets of foil in a cigarette packing machine comprises a transfer drum 1 supported so as to rotate about its axis. The transfer drum 1 rotates preferably stepwise, and around its periphery are a plurality of cigarette-carrying cells 2, in particular four cigarette-carrying cells 2, distributed at equal intervals and open on the peripheral surface of the drum. The cigarette-carrying cells 2 are intended to hold a group 3 of cigarettes S already arranged in the predetermined arrangement which the cigarettes S are to assume in the finished packet. The cells are oriented such that the longer transverse side of the group of cigarettes 3 lies in the radial direction of the transfer drum 1. The transfer drum 1 has the function of carrying said ordered groups 3 of cigarettes S from a pick-up point P to a transfer point T where the group of cigarettes 3 is transferred to a coinciding empty peripheral cell 2' of a folding drum 7 which likewise has cells. The folding drum 7 is also turned stepwise about an axis parallel to that of the transfer drum 1 and is aligned therewith.

The groups of cigarettes 3 are preformed upstream of the transfer drum 1 and are fed into the pick-up point P by means of, for example, tubular conveying cradles 4 mounted side by side on an endless conveyor belt 6. At the pick-up point P the cells 2 of the transfer drum 1 are brought one by one to a position that coincides axially with the respective tubular cradle 4 and the corresponding group 3 of cigarettes is passed into the cigarette-carrying cell 2 in an axial translational displacement of the cigarettes S by means of a pusher or the like (not shown).

The position of the transfer point T relative to the pick-up point P is such that whenever an empty cigarette-carrying cell 2 is at the pick-up point P, a loaded cigarette-carrying cell 2 is simultaneously at the transfer point T in a position coinciding face to face with an empty cigarette-carrying cell 2' of the folding drum 7. There is fed in at the transfer point T, next to each cigarette-carrying cell 2 and in a predetermined position with respect to said cell, between said cigarette-carrying cell 2 of the transfer drum 1 and the empty cigarette-carrying cell 2' of the folding drum 7, a sheet of foil 8. The transfer of the group of cigarettes 3 from the cigarette-carrying cell 2 to the coinciding cell 2' of the folding drum 7 is accomplished by means of the translation of the group of cigarettes 3 in a radial direction transversely to the axis of the cigarettes S. In FIG. 1 the displacement means are depicted schematically by a pusher 9. At the same time the group of cigarettes 3 pulls the sheet of foil 8 into the cell 2', thereby folding it into a U shape as indicated by 8' in FIG. 1.

Each cigarette-carrying cell 2' of the folding drum 7 is then moved to a plurality of successive folding locations where other folding means (not shown) fold the projecting flaps of the sheet 8' (already folded into a U shape) so as to enclose the corresponding group of cigarettes 3.

The sheets of foil 8 are cut from a web of foil 8" by means of a rotating blade forming part of a feeding and cutting unit indicated as a whole by the reference 10 and comprising at least two pairs of opposing powered feeder rollers 110, 210.

The feeding and cutting unit 10 is preferably situated underneath the transfer drum so that the web of foil 8' or at least the cut sheet 8 is fed vertically with it.

With reference to FIG. 2, the transfer drum 1 is mounted on and rotates with a projecting shaft 11 supported rotatably in the frame 12 and turned stepwise by a motor through an intermittent transmission 13 or "rotoblock". In the example illustrated the transmission 13 consists of a two-dimensional cam 113 in which rollers 111 mounted on the ends of radial rods 211 projecting from the shaft 11 engage.

The sheet of foil 8 cut from the web 8' is picked up and carried into the correct predetermined position at the transfer point T by means of a pick-up/positioning drum.

The sheet 8 pick-up/positioning drum consists of two discs 14 positioned coaxially with each other and with respect to the transfer drum 1 on both sides of the latter. The discs 14 are coupled so as to rotate with each other and with respect to the shaft 11 of the transfer drum 1, each by means of its own hub 15 which rotates on bearings 16 about the shaft 11 on the corresponding side of the transfer drum 1. Each hub 15 is coupled in rotation to a coaxial pulley, or in particular a toothed wheel 17 made e.g. in one piece therewith, around which runs a belt, in particular a toothed belt 18, that is turned by a driven pulley or sprocket 19. The sprockets 19 are fixed to and rotate with a common shaft 20 of a common independent motor 21. The motor 21 is supported in the frame 12 and its shaft 20 projects from it. Furthermore the free end of the shaft 20 is also supported rotatably in a bracket 23 in which the free end of the shaft 11 of the transfer drum 1 is also held.

The discs 14 comprise around their periphery a predetermined identical number of sheet-placing sectors 114 operating by suction. These are distributed at equal angles and coincide with each other in pairs. The sheet-placing sectors 114 are formed by peripheral segments of the discs 14 that project a short radial distance beyond the peripheral edge of the transfer drum 1. Emerging around their edges are suction ducts 214 formed in the thickness of the discs 14 and connected by suction ducts 115 inside the hubs 15 with an external suction source (not shown) with the aid of airtight rotating connections shown schematically and indicated by the reference 22.

The sheet-placing sectors 114 are slightly longer than the sheets of foil 8 and their axial distance apart is less than the dimension in the axial direction of these sheets of foil 8.

In order to reduce the inertial mass of the pick-up/positioning drum, the sheet-placing segments 114 are advantageously supported by arms 314. In this case, the suction ducts 114 are formed in said arms 314. The arms 314 may consist, as shown, of circular sectors of the discs 14.

As each pair of adjacent suction segments of the discs 14 passes the foil sheet 8 feeding and cutting unit 10, the corresponding sheet 8 is picked up by suction by said pair of suction segments which then carry it to the transfer point T, positioning it correctly with respect to the cigarette-carrying cell 2 of the transfer drum 1. The movement of the pick-up/positioning drum is independent of that of the transfer drum 1 and said pick-up/positioning drum is made to pause once the sheet 8 is in its correct position on the command of a pair of sensors 24 which detect the position and presence of this sheet 8. Said sensors 24 may be a pair of sensors arranged side by side in the direction of rotation and may be of any type, for example one to emit a light barrier and the other to receive it, and suchlike.

With reference to FIG. 1, in the example illustrated, the number (in particular three) of sheet-placing sectors 114 on the pick-up/positioning drum is less than the number of cigarette-carrying cells 2 on the transfer drum 1. The transfer drum 1 and the pick-up/positioning drum are therefore driven independently at relative speeds such that at the transfer point T the presence of each loaded cigarette-carrying cell 2 of the transfer drum 1 coincides more or less with the presence of a sheet of foil 8.

Because of the independent drive to the pick-up/positioning drum, and because of the position sensors 24, the sheet 8 can always be positioned accurately relative to the cells 2, 2' of the two drums 1 and 7, independently of operating speeds.

The invention is obviously not limited to the embodiments described above and illustrated and may be greatly varied and modified, especially from the structural point of view. In fact, the feeder device according to the invention is not limited to the use illustrated in the example, but can also be used for feeding and positioning wrapper sheets of any type and dimensions in packaging machines for similar or other kinds of products. With particular reference to cigarette packing machines, the device according to the invention can also be used in much the same way both for the feeding and correct positioning of external packaging sheets for making so-called soft packets, in which each group of cigarettes, optionally already enclosed in the foil sheet, is wrapped in an extra wrapping sheet of paper, and for the feeding and correct positioning of cardboard blanks and the like for making so-called rigid packets. None of these variants would constitute a departure from the underlying principle described above and claimed below.

We claim:

1. A device for placing wrapper sheets around groups of elongate objects comprising:

a folding drum in which individual wrapper sheets are folded around individual groups of the objects, said folding drum including a periphery and a plurality of folding cells in the periphery;

a transfer drum which transfers individual groups of the objects from a feed line of the groups to said folding drum, said transfer drum including sides, a rotational axis, and a plurality of transfer cells, each respective said transfer cell receiving a respective group from the feed line and being moved to a transfer point where a respective one of said folding cells is provided in a coinciding position of alignment to receive the group in the respective said folding cell;

a displacement means for moving, when said transfer cell is aligned with said folding cell, the group in said transfer cell to said folding cell;

a pick-up/positioning drum which picks up a wrapper sheet and positions the wrapper sheet at the transfer point between the aligned said transfer cell and said folding cell before operation of said displacement means so that as the group is moved by said displacement means from the aligned said transfer cell the wrapper sheet is pushed by the group into the aligned said folding cell and folded about the group in a U shape, said pick-up/positioning drum including two discs arranged against the sides of said transfer drum, said discs being coaxial with one another and with the rotational axis of said transfer drum, said discs being coupled together for rotation with one another and for independent rotation relative to said transfer drum, including peripheral sheet-placing sectors for each said disc by which the wrapper sheets are picked up and positioned; and a driving means for driving said pick-up/positioning drum at a different speed than said transfer drum such that one wrapper sheet is brought simultaneously with each said transfer cell to the transfer point.

2. A device as claimed in claim 1 wherein there is a number of said peripheral sheet-placing sectors which is different from a number of said transfer cells.

3. A device as claimed in claim 1 wherein the objects are cigarettes and the wrapper sheets are made of foil.

4. A device as claimed in claim 1 wherein said folding drum and said transfer drum are turned stepwise, pausing at at least the transfer point; and further including a first motor driving said pick-up/positioning drum, and stationary sensors sensitive to a position of the wrapper sheet at the transfer point for causing said first motor to pause said pick-up/positioning drum at the transfer point when the wrapper sheet is positioned thereat.

5. A device as claimed in claim 4 wherein said stationary sensors are also sensitive to a presence of the wrapper sheet at the transfer point.

6. A device as claimed in claim 4 wherein said sheet-placing sectors hold the wrapper sheets by suction.

7. A device as claimed in claim 6 wherein said discs of said pick-up/positioning drum include peripheral edges; and wherein said sheet-placing sectors include suction areas in said peripheral edges of said discs with said suction areas of one said disc aligned adjacently with said suction areas in the other said disc in pairs.

8. A device as claimed in claim 7 wherein said sheet-placing sectors extend to a radial distance from the rotational axis which is slightly greater than an external radius of said transfer drum, and said sheet-placing sectors have a circumferential length at least equal to a circumferential length of the wrapper sheets when the wrapper sheets are picked up by said sheet-placing sectors.

9. A device as claimed in claim 8 wherein said sheet-placing sectors have an axial length therebetween which is less than an axial length of the wrapper sheets when the wrapper sheets are picked up by said sheet-placing sectors.

10. A device as claimed in claim 9 wherein each said disc includes a hub and radial arms extending from said hub which carry respective said sheet-placing sectors.

11. A device as claimed in claim 10 wherein each said disc includes equiangularly distributed circular portions having peripheral edges which form said sheet-placing sectors.

12. A device as claimed in claim 11 wherein said radial arms include first suction ducts formed radially therein with said first suction ducts having openings at the peripheral edges of said circular portions; wherein each said hub includes second suction ducts therein connected at one end to respective said first suction ducts of an associated said disc; and further including a mobile airtight connection connecting the other end of said second suction ducts to a source of suction.

13. A device as claimed in claim 12 wherein said transfer drum includes a drive shaft; and wherein said discs are independently and freely supported on said drive shaft and are coupled together by (a) a common shaft, (b) a second motor which drives said common shaft, and (c) an independent transmission for each said disc which said transmissions are dynamically driven by said common shaft.

14. A device as claimed in claim 13 wherein said common shaft projects from said second motor parallel to the rotation axis; and wherein each said independent transmission includes a first wheel fixed to said common shaft, a second wheel attached to and coaxial with the associated said disc, and a belt drivingly connecting said first and second wheels.

15. A device as claimed in claim 14 wherein said rotational axis is horizontal; and further including a cutting and feeding unit for cutting the wrapper sheets from a continuous web and for feeding the cut wrapper sheets to said pick-up/positioning drum in vertical alignment therewith and in a predetermined orientation correlated to the positions of the wrapper sheets at the transfer point.

16. A device as claimed in claim 15 wherein said drive shaft of said transfer drum extends therefrom and is parallel with said common shaft, and each of said drive shaft and said common shaft include a free end; and further including a common member in which said free ends of said drive shaft and said common shaft are supported for free rotation.

* * * * *